US009895909B2

(12) United States Patent
Fujiwara

(10) Patent No.: US 9,895,909 B2
(45) Date of Patent: Feb. 20, 2018

(54) PRINTER

(71) Applicant: TOSHIBA TEC KABUSHIKI KAISHA, Shinagawa-ku, Tokyo (JP)

(72) Inventor: Tsutomu Fujiwara, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 24 days.

(21) Appl. No.: 15/259,302

(22) Filed: Sep. 8, 2016

(65) Prior Publication Data

US 2017/0144459 A1 May 25, 2017

(30) Foreign Application Priority Data

Nov. 19, 2015 (JP) ..... 2015-226996

(51) Int. Cl.

| | |
|---|---|
| ***B41J 2/32*** | (2006.01) |
| ***B41J 11/70*** | (2006.01) |
| ***B41J 3/407*** | (2006.01) |
| ***B41J 13/10*** | (2006.01) |
| ***B41J 11/00*** | (2006.01) |

(52) U.S. Cl.

CPC ..... *B41J 11/70* (2013.01); *B41J 2/32* (2013.01); *B41J 3/4075* (2013.01); *B41J 11/002* (2013.01); *B41J 11/703* (2013.01); *B41J 13/10* (2013.01)

(58) Field of Classification Search

CPC ... B41J 2/32; B41J 3/4075; B41J 11/04; B41J 15/042

See application file for complete search history.

(56) References Cited

U.S. PATENT DOCUMENTS

2016/0263881 A1* 9/2016 Chida ..... B32B 43/006
2017/0217705 A1* 8/2017 Hoshi ..... B65H 7/06 399/21

FOREIGN PATENT DOCUMENTS

JP 2015-062986 4/2015

* cited by examiner

*Primary Examiner* — Lamson Nguyen
(74) *Attorney, Agent, or Firm* — Amin, Turocy & Watson LLP

(57) ABSTRACT

In accordance with an embodiment, a printer comprises a label holding section configured to hold a label roll formed by winding a belt-shaped label on the back surface of which an adhesive layer activated through heating at a temperature lower than a thermal color developing temperature of a printing surface is arranged without a mount; a cutting section configured to sandwich the label from the printing surface side and the adhesive layer side to cut it; and a printing section configured to be arranged at the downstream side of a label conveyance direction with respect to the cutting section and print on the printing surface of the label through a thermal head.

13 Claims, 2 Drawing Sheets

PRINTER

CROSS-REFERENCE TO RELATED APPLICATION

This application is based upon and claims the benefit of priority from Japanese Patent Application No. P2015-226996, filed Nov. 19, 2015, the entire contents of which are incorporated herein by reference.

FIELD

Embodiments described herein relate generally to a printer and associated methods.

BACKGROUND

Conventionally, there is a printer used to carry out printing on a label and issuing the printed label. On the back surface opposite the printing surface of the label is an adhesive layer. The label used in such a printer includes a label with amount and a label without a mount, both of which are wound into a roll shape and are set in a sheet holding section of the printer. The label with the mount is formed by attaching a label that is already cut into a predetermined size to a belt-shaped mount and then winding the label into a roll shape. The label without the mount is formed by winding a belt-shaped label into a roll shape and is cut off at the time of issuance.

As the mount of the label with the mount becomes rubbish after the printing and issuing, a user who wants to avoid such a disposal problem uses the label without the mount.

The label without the mount is held, conveyed, printed, cut and issued in a state in which the adhesive layer is exposed. In such a constitution, there is a concern that such a label is undesirably attached to the inside of the printer. Thus, conventionally, various measures are taken to prevent the undesirable attachment of the label to each section of the printer. However, it is difficult to find a reliable preventive measure and there is still room for improvement.

DETAILED DESCRIPTION

In accordance with an embodiment, a printer comprises a label holder, a cutter and a printing section. The label holder holds a wound label roll made of a belt-shaped label on the back surface of which an adhesive layer activated through the heating at a temperature lower than a thermal color developing temperature of a printing surface is arranged without amount. The cutter sandwiches the label roll from the printing surface side and the adhesive layer side to cut the label roll separating a printed portion from the remaining unprinted portion. The printing section is arranged at a downstream side of a label conveyance direction with respect to the cutter and prints on the printing surface of the label through a thermal head.

In accordance with another embodiment, a printing method involves sandwiching a label roll comprising a belt-shaped label on the back surface of which an adhesive layer activated through heating at a temperature lower than a thermal color developing temperature of a printing surface is arranged without a mount from a printing surface side and an adhesive layer side to cut the label roll; and subsequently printing surface of the label roll using a thermal head.

First Embodiment

Figure 1:
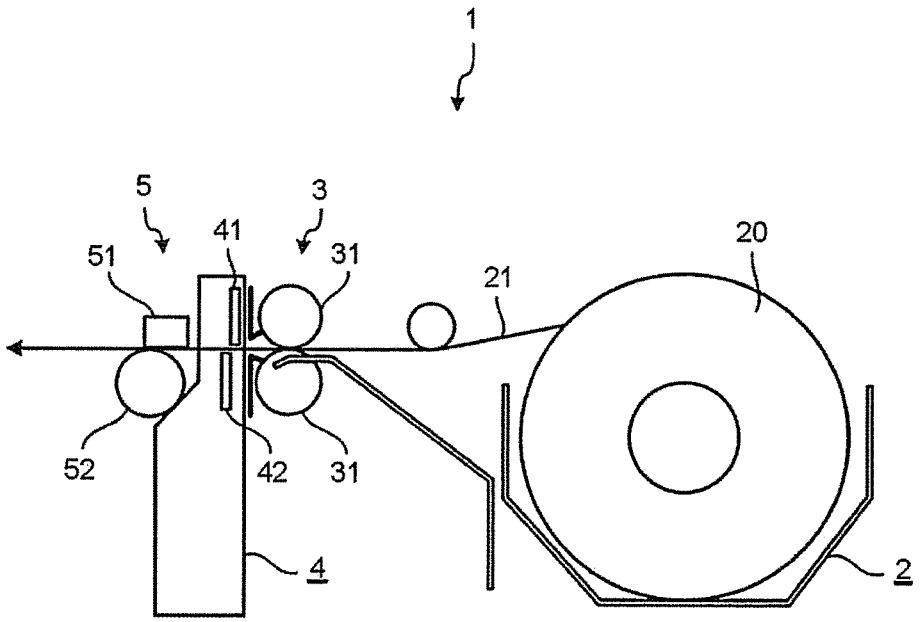
FIG. 1 is a diagram schematically illustrating the constitution of a printer according to a first embodiment.

The first embodiment is described with reference to the accompanying drawings. In the present embodiment, a thermal printer using a thermal head to print is described as an example of the printer. FIG. 1 is a diagram schematically illustrating the constitution of a printer 1 according to the present embodiment. The printer 1 is equipped with a label holder or roll paper holding section 2, a relay section 3, a cutter or cutting section 4 and a printing section 5.

In the present embodiment, as a roll paper 20, a label roll formed by winding the label without the mount (hereinafter, simply referred to as a label) is used. The label 21 is a belt-shaped paper (alternatively, a film-like or a sheet-like printing medium) and includes an adhesive layer on the back surface of a printing surface thereof. The printing surface of the label 21 drawn out from the roll paper 20 faces up, and the adhesive layer thereof faces down.

The adhesive layer of the label 21 according to the present embodiment is formed by an adhesive activated (representing adhesion) through the heating. In other words, the adhesive layer is not sticky or in a state difficult to stick before being heated through the printing. As the adhesive layer covers the printing surface in a state of winding a conventional label without the mount, it is necessary to execute a process of making it difficult for the adhesive layer to adhere to the printing surface of the conventional label without the mount. However, the process described above is not necessary for the label 21 used in the present embodiment.

For example, there is description in the following document about the label paper including such an adhesive layer activated through the heating.

On pages 149~455 of *Ricoh Technical Report* No. 31 (DECEMBER, 2005)

"Development on heat activated linerless label without using release paper"

Update on RICOH's Heat Activated Linerless Technology Tomoyuki Kugo, Norihiko Inaba The roll paper holding section (label holding section) 2 holds the roll paper 20 in such a manner that the winding center becomes substantially horizontal.

If the roll paper 20 is a normal roll paper, as end surfaces thereof are stuck through the adhesive, it is necessary to execute a non-adhesion process on a member for pressing the end surfaces of the roll paper 20 in the roll paper holding section 2. The process is, for example, a process of coating the adhesive with a material having non-adhesion such as fluorine resin. However, as the adhesive layer of the label 21 according to the present embodiment has no or slight adhesion in a state of not being heated, there is no need to execute the non-adhesion process in the roll paper holding section 2.

The relay section 3 sends the label 21 between the roll paper holding section 2 and the cutting section 4. The relay section 3 is equipped with a pair of conveyance rollers 31 for sandwiching the label 21 therebetween from upside and downside. One (or both) of the conveyance rollers 31 is driven by a motor (not shown) to rotate.

The cutting section 4 is equipped with a fixed blade 41 and a moveable blade 42. The fixed blade 41 including a cutting edge facing the printing surface of the label 21 is arranged at the upper side of the conveyance path of the label 21. The moveable blade 42 including a cutting edge facing the adhesive layer of the label 21 is arranged at the lower side of the conveyance path of the label 21 to be vertically removable. Through vertically removing the moveable blade 42, the label 21 is cut off at a position at which the label 21 is sandwiched by the cutting edges of the moveable blade 42 and the fixed blade 41.

The printing section 5 is arranged at the downstream side of the label conveyance direction with respect to the cutting section 4. The printing section 5 is equipped with a thermal head 51 and a platen roller 52. The thermal head 51 is equipped with a plurality of aligned heat generation elements and enables each heat generation element to generate heat under the control of the control section (not shown).

The heat generation temperature of the heat generation element is, for example, about 65~90 degrees centigrade. The temperature is coincident with the color developing temperature of the label 21. The label 21 has a thermal color developing agent layer on the printing surface thereof. The thermal color developing agent starts to develop color at 55~65 degrees centigrade, and reaches the maximum consistency at 65~90 degrees centigrade. The temperature at which the adhesive forming the adhesive layer is activated is, for example, about 40~50 degrees centigrade, and is lower than the temperature at which the thermal color developing agent develops color.

The platen roller 52 is used to press the label 21 towards the thermal head 51. The process of making it difficult for the adhesive layer of the label 21 to adhere is executed on the platen roller 52. The process is, for example, a silicone oil impregnation process. The platen roller 52 is rotationally driven by a motor (not shown) to give a conveyance force to the label 21.

The printer 1 houses each section (the roll paper holding section 2, the relay section 3, the cutting section 4 and the printing section 5) described above in a main body casing (not shown). The main body casing includes an issuing port (not shown) at a position hitting the downstream side of the label conveyance direction with respect to the printing section 5. The label 21 is issued from the issuing port.

In such a constitution, the label 21 drawn out from the roll paper 20 held in the roll paper holding section 2 is cut by the cutting section 4 at the upstream side with respect to the printing section 5 and then is issued. In this way, as the cutting section 4 can cut the part where the adhesive layer of the label 21 is not activated, the failure that the label 21 adheres to the cutting section 4 can become difficult to occur.

Further, in a case in which the distance between the printing range and a desired cutting position is smaller than the distance between the printing section 5 and the cutting section 4, the printer 1 reversely rotates the platen roller 52 with a motor after the printing to feed back the label 21 to match the desired cutting position with the cutting section 4. In this way, even in a case in which it is not desired to take a large margin, the desired cutting position can be matched with the cutting section 4.

Through the above, according to the present embodiment, as the activation of the adhesive layer is executed immediately before issuance, the measure taken to prevent the adhesion of the label 21 needs to be applied to only the platen roller 52. In other words, one of the advantages of this embodiment is that it is possible that the non-adhesion process (process of coating the adhesive with a material such as fluorine resin having non-adhesion) is unnecessary for each section through which the label 21 passes in the printer 1.

First Modification

In the first embodiment, the printing section 5 may print contents at a margin part of the printing surface other than contents displayed on the label 21. The margin part is, for example, ends of the label 21, in other words, the part nearby a part to be edge after the cutting.

In this way, without damaging the display content of the label 21, as an activated area of the adhesive layer can be increased, the adhesion force of the label 21 can be improved.

Further, for example, a frame border is printed in the present modification; however, lines may not be printed on all one lap of the outer peripheral section of the label 21. For example, by printing a line on either one side, the adhesion of the side is increased and the label 21 may be used like a tag.

Second Modification

In the first embodiment, the printing section 5 executes printing of the contents displayed on the label 21, and simultaneously may not execute the heating operation to enable the adhesive layer to be activated at a part where the printing is not executed. In other words, while characters are written down on the label 21, only heat quantity at which the adhesive layer on the back surface is activated is applied to the part where the characters are not written down. In the present processing, the printer 1 executes heat history management of the thermal head 51 as carried out with a gradation control of printing.

In this way, without damaging the display content of the label 21, as the activated area of the adhesive layer can be further increased, the adhesion force of the label 21 can be improved.

Furthermore, in the present modification, further, the foregoing processing may be executed only in a case in which the printing rate is low (the content displayed on the label 21 is small). In this way, in a case in which the printing rate of the label 21 is high to some extent and the adhesive thereof is sufficiently obtained, the processing such as the heat history management can be unnecessary and the printing speed can be advantageously increased.

Second Embodiment

The second embodiment is described with reference to the accompanying drawings. In the present embodiment, the description of the part same as the first embodiment is omitted, and only the parts different with the first embodiment are described.

Figure 2:
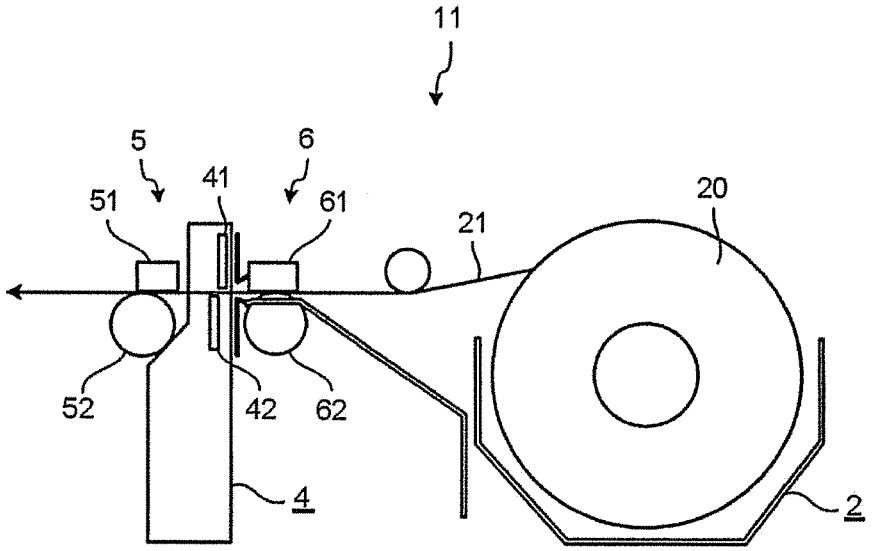
FIG. 2 is a diagram schematically illustrating the constitution of a printer according to a second embodiment.

FIG. 2 is a diagram schematically illustrating the constitution of a printer 11 according to the present embodiment. The printer 11 of the present embodiment includes a preheating section 6 at a position where the relay section 3 is arranged in the printer 1 of the first embodiment. The preheating section 6 preheats (preheats, pre-heats, weakly activates) the label 21 to a temperature at which the adhesive is not activated, in other words, the label 21 does not reach the color developing temperature.

The preheating section 6 is equipped with a thermal head 61 and a press roller 62. The thermal head 61 heats the label 21. The temperature at which the thermal head 61 heats the label 21 is lower than the color developing temperature of the label 21 and is further lower than the activation temperature of the adhesive. The press roller 62 presses the label 21 towards the thermal head 61.

According to such a constitution, before the printing by the printing section 5, as the preheating section 6 preheats the label 21, the heating quantity at the time of the printing by the printing section 5 can be reduced. In other words, the heating quantity required for the printing on the label 21 and the activation (strong activation with respect to the foregoing weak activation) of the adhesive layer can be shared by the preheating section 6 and the printing section 5. Thus, the issuing speed of the label 21 can be advantageously improved.

The constitution component of the preheating section 6, which acts as the thermal head 61 in the present embodiment, may be a heat roller. As a heater is built in the heat roller, the heat roller heats an object contacting the outer peripheral surface of the heater. In a case of constituting the preheating section 6 with the heat roller instead of the thermal head 61, a case in which the heat roller is arranged at the adhesive layer side and the press roller 62 is arranged at the printing surface side is more preferable in view of the heating efficiency.

Third Embodiment

The third embodiment is described with reference to the accompanying drawings. In the present embodiment, the description of the part same as the first embodiment is omitted, and only the parts different with the first embodiment are described.

Figure 3:
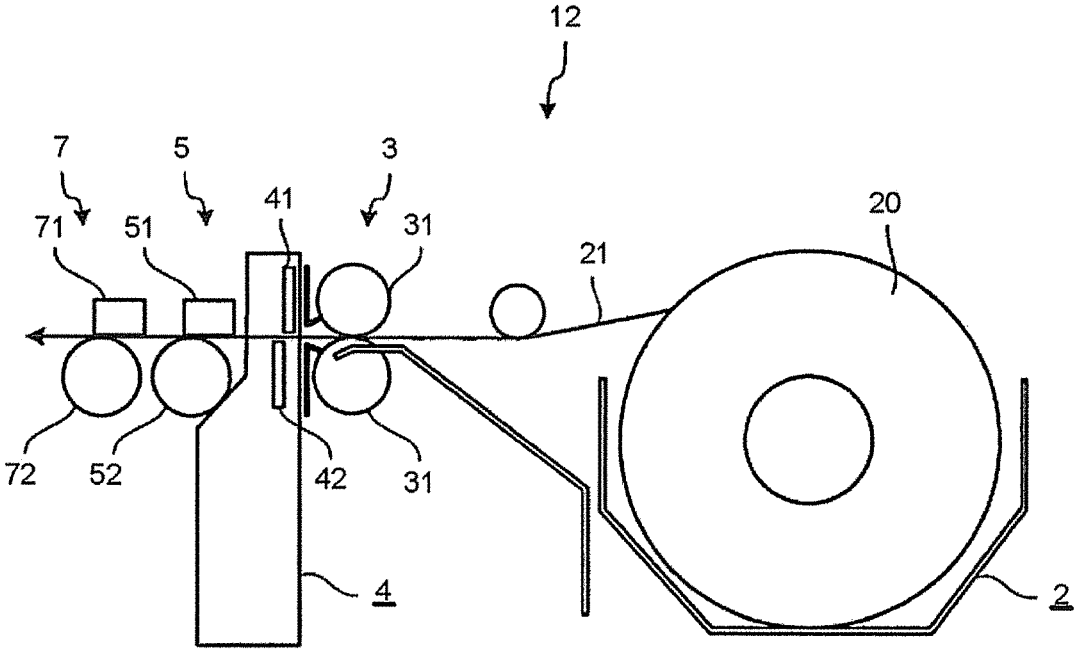
FIG. 3 is a diagram schematically illustrating the constitution of a printer according to a third embodiment.

FIG. 3 is a diagram schematically illustrating the constitution of a printer 12 according to the third embodiment. The printer 12 of the present embodiment further includes a heating section 7. The heating section 7 is arranged between the printing section 5 and the issuing port in the printer 1 of the first embodiment, in other words, at the downstream side of the label conveyance direction with respect to the printing section 5. The heating section 7 heats the label 21 to a temperature at which the adhesive layer is activated but the label 21 does not reach the color developing temperature.

The heating section 7 is equipped with a thermal head 71 and a press roller 72. The thermal head 71 heats the label 21. The temperature at which the thermal head 71 heats the label 21 is lower than the color developing temperature of the label 21 and is equal to or higher than the activation temperature of the adhesive. The press roller 72 presses the label 21 towards the thermal head 71. The process of making it difficult for the adhesive layer of the label 21 to attach is executed on the press roller 72. The process is, for example, the silicone oil impregnation process.

According to such a constitution, after the printing in the printing section 5, the heating section 7 can properly heat the adhesive layer of the label 21. Thus, according to the present embodiment, even if the heat history management of the thermal head 51 is not executed as shown in the second modification of the first embodiment, the adhesive layer of the label 21 can be thoroughly activated.

Further, the heating section 7 may activate the adhesive layer of the label 21 without clearance, or may heat the label 21 in a dot-like or stripe-like manner.

The constitution component of the heating section 7, which acts as the thermal head 71 in the present embodiment, may be a heat roller. As a heater is built in the heat roller, the heat roller heats an object contacting the outer peripheral surface of the heater. In a case of constituting the heating section 7 with the heat roller instead of the thermal head 71, a case in which the heat roller is arranged at the adhesive layer side and the press roller 72 is arranged at the printing surface side is more preferable in view of the heating efficiency.

In the foregoing embodiments, the label 21 is used as a thermal paper; however, the embodiment is not limited to that. In other words, there is no thermal color developing agent layer on the printing surface of the label 21, and the printing section 5 may print using an ink holding medium such as an ink ribbon. In a case in which the ink holding medium is the ink ribbon, in the third embodiment, if the temperature required for the ink transfer of the ink ribbon is lower than the activation temperature of the adhesive layer, the measure taken to prevent the attachment of the label 21 in the printing section 5 becomes unnecessary.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to quantities, temperatures, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a label holder configured to hold a wound label roll comprising a belt-shaped label on the back surface of which an adhesive layer activated through heating at a temperature lower than a thermal color developing temperature of a printing surface is arranged without a mount;

a cutter configured to sandwich the label roll from the printing surface side and the adhesive layer side to cut the label roll; and a printing section configured to be arranged at a downstream side of a label conveyance direction with respect to the cutter and print on the printing surface of the label roll through a thermal head.

2. The printer according to claim 1, further comprising a preheating section configured to be arranged at the upstream side of the label conveyance direction with respect to the printing section to heat a printed portion of the label roll to a temperature lower than a temperature at which the adhesive layer is activated.

3. The printer according to claim 1, wherein the printing section carries out printing to activate the adhesive layer at a margin part of the printing surface where contents displayed on the label roll are not printed.

4. The printer according to claim 2, wherein the printing section carries out printing to activate the adhesive layer at a margin part of the printing surface where contents displayed on the label roll are not printed.

5. The printer according to claim 1, further comprising a heating section configured to be arranged at the downstream side of the label conveyance direction with respect to the printing section to heat the printed portion of the label roll to a temperature at which the adhesive layer is activated.

6. The printer according to claim 2, further comprising a heating section configured to be arranged at the downstream side of the label conveyance direction with respect to the printing section to heat the printed portion of the label roll to a temperature at which the adhesive layer is activated.

7. A printer, comprising:

a label holder configured to hold a wound label roll comprising a belt-shaped label, arranged without mount, which has an adhesive layer activated through heating at a predetermined or higher temperature on the back surface of a printing surface which does not thermally develop color;

a cutter configured to sandwich the label roll from the printing surface side and the adhesive layer side to cut the label roll;

a printing section configured to print on the printing surface of the label roll through a thermal head or an ink holding medium; and a heating section positioned at a downstream side of a label conveyance direction with respect to the cutter and the printing section and configured to heat the printed portion of the label roll to a temperature at which the adhesive layer is activated.

8. A printing method, comprising:

sandwiching a label roll comprising a belt-shaped label on the back surface of which an adhesive layer activated through heating at a temperature lower than a thermal color developing temperature of a printing surface is arranged without a mount from a printing surface side and an adhesive layer side to cut the label roll; and subsequently printing surface of the label roll using a thermal head.

9. The printing method according to claim 8, further comprising

Before printing, heating a printed portion of the label roll to a temperature lower than a temperature at which the adhesive layer is activated.

10. The printing method according to claim 8, wherein printing activates the adhesive layer at a margin part of the printing surface where contents displayed on the label roll are not printed.

11. The printing method according to claim 9, wherein printing activates the adhesive layer at a margin part of the printing surface where contents displayed on the label roll are not printed.

12. The printing method according to claim 8, further comprising after printing, heating the printed portion of the label roll to a temperature at which the adhesive layer is activated.

13. The printing method according to claim 9, further comprising after printing, heating the printed portion of the label roll to a temperature at which the adhesive layer is activated.

* * * * *